US005205613A

United States Patent [19]

Brown, Jr.

[11] Patent Number: 5,205,613

[45] Date of Patent: Apr. 27, 1993

[54] TUNNEL BORING MACHINE WITH CONTINUOUS FORWARD PROPULSION

[75] Inventor: Howard K. Brown, Jr., Kent, Wash.

[73] Assignee: The Robbins Company, Kent, Wash.

[21] Appl. No.: 716,849

[22] Filed: Jun. 17, 1991

[51] Int. Cl.[5] ..... E21C 29/00; E21D 9/08

[52] U.S. Cl. ..... 299/31; 299/33; 405/138; 405/142

[58] Field of Search ..... 299/31, 33, 55, 56, 299/58; 405/138, 141, 142; 175/61, 62

[56] References Cited

U.S. PATENT DOCUMENTS

| | | | |
|---|---|---|---|
| Re. 31,511 | 1/1984 | Spencer | 299/56 |
| 3,203,737 | 8/1965 | Robbins et al. | 299/31 |
| 3,295,892 | 1/1967 | Winberg et al. | 299/31 |
| 3,861,748 | 1/1975 | Cass | 299/10 |
| 3,967,463 | 7/1976 | Grandori | 299/33 X |
| 4,420,188 | 12/1983 | Robbins et al. | 299/31 |
| 4,548,443 | 10/1985 | Turner | 299/31 |
| 4,915,453 | 4/1990 | Fikse | 299/31 |
| 5,005,911 | 4/1991 | Fikse | 299/31 |

FOREIGN PATENT DOCUMENTS

| | | | |
|---|---|---|---|
| 2252308 | 7/1973 | Fed. Rep. of Germany | 299/31 |

OTHER PUBLICATIONS

Traylor Brothers, Inc. Drawings dated about Dec. 4, 1981 Entitled: 92-192-1 Stillwater Modifications; 92-192-2 Stillwater Modif. Utilizing Temp. Support; 92-192-3 Propel Sequence; 92-192-4 TBM Hydraulic Schematic; 92-192-5 Blade Skewing and Spiling.

*Primary Examiner*—David J. Bagnell

*Attorney, Agent, or Firm*—Graybeal Jackson Haley & Johnson

[57] ABSTRACT

A tunnel boring machine includes a cutterhead having a plurality of cutting units and being rotatable on a machine frame. Two sets of three anchor shoes float relative to the frame and are disposed circumferentially, with the anchor shoes of the two sets alternating on the frame. The two sets of three anchor shoes allow continuous advance of the tunnel boring machine. Connection between the two sets of anchor shoes and the frame is provided by two sets of three thrust cylinder bipods. One set of three thrust cylinder bipods is connected to each set of three floating anchor shoes, with one bipod attached to each anchor shoe. All of the anchor shoes in each set are interconnected by three pairs of floating gripper cylinders, with each pair of gripper cylinders longitudinally spaced on the two anchor shoes that they connect. Each of the two sets of three anchor shoes is sequentially gripped and ungripped with the tunnel wall by the attached gripper cylinders and independently of the other set of anchor shoes. The ungripped set of three anchor shoes and the frame are advanced with respect to the gripped set of three anchor shoes by the three thrust cylinder bipods connected to the gripped set of three anchor shoes.

19 Claims, 6 Drawing Sheets

FIG. 4
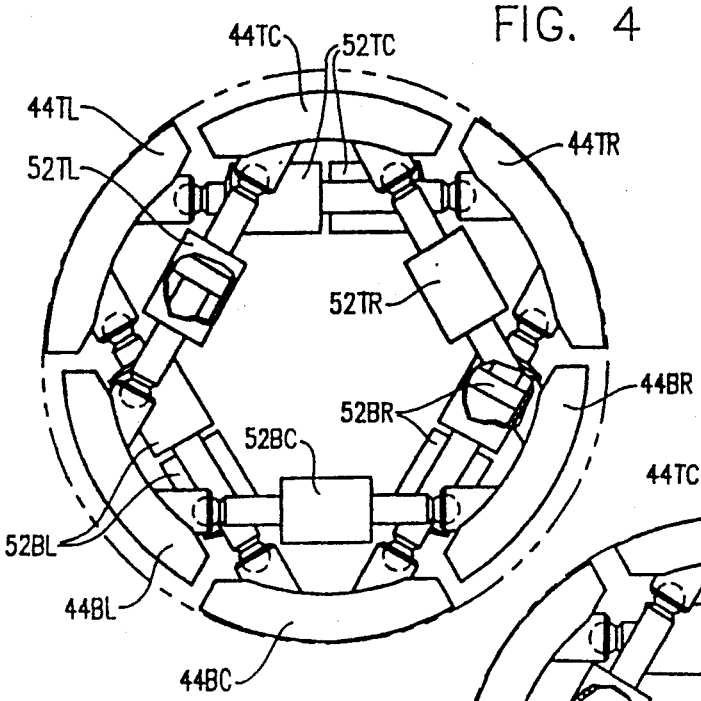
FIG. 5
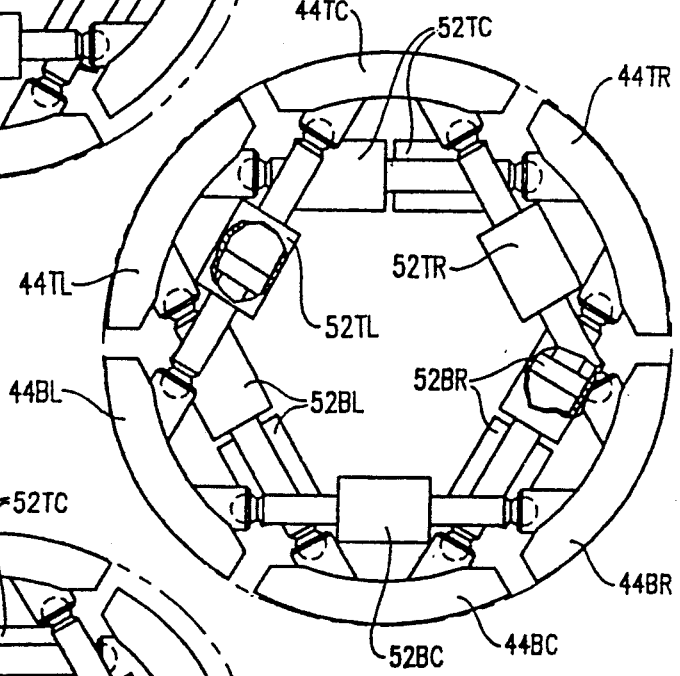
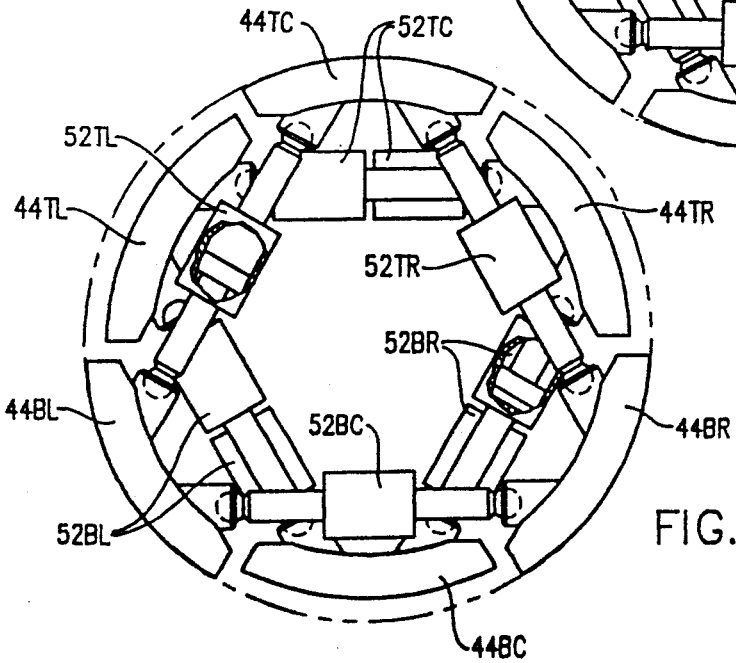
FIG. 6

TUNNEL BORING MACHINE WITH CONTINUOUS FORWARD PROPULSION

BACKGROUND OF THE INVENTION

The invention pertains to tunnel boring machines in general, and more specifically to tunnel boring machines having walking gripper shoes for continuous forwrd movement thereof. Continuous tunnel boring machines are desirable over tunneling machines which bore intermittently due to the fact that the tunnel can be completed in shorter time, thus resulting in lesser machine and machine operator costs.

The following are tunnel boring machines generally known in the art. U.S. Pat. No. 4,915,453, issued to Fikse, discloses a walking gripper shoe tunnel boring machine which carries a rotary cutterhead that can be propelled forwardly substantially continuously by exerting advancing thrust forces on the cutterhead continuously. The advancing thrust forces are first exerted by top and bottom bipods reacting from top and bottom anchor shoes, also known as gripper shoes, in anchored condition against the tunnel wall. Next, side bipods exert advancing force on the tunneling machine frame. These side bipods react from side anchor shoes set in anchored condition against the tunnel wall while the top and bottom anchor shoes "walk" or "float", i.e. slip, relative to the tunneling machine body, and are directly connected by two pairs of anchor shoe setting jacks extending cordwise between the shoes. The side anchor shoes also "walk" or "float" relative to the tunneling machine body and are directly connected by two pairs of transverse jacks extending cordwise between the shoes. The two pairs of upright jacks are located close together longitudinally on the tunnel boring machine and between the two transverse jacks. The above Fikse patent, which is incorporated herein by reference, refers to numerous other tunnel boring machines known in the art including U.S. Pat. No. 3,203,737, issued to Robbins et al, U.S. Pat. No. 3,295,892, issued to Winberg et al, U.S. Pat. No. 3,861,748, issued to Cass, U.S. Pat. No. 3,967,463, issued to Grandori, U.S. Pat. No. 4,420,188, issued to Robbins et al, U.S. Pat. No. 4,548,433, issued to Turner, U.S. Pat. No. 31,511, issued to Spencer, and a tunneling machine operated at Stillwater, Utah, by Traylor Bros. Incorporated, during 1981 and 1982.

Regarding the tunneling machine operated at Stillwater, Utah, this machine had a rotary cutterhead on a machine frame. Twelve advancing jacks interconnected the machine frame with twelve circumferentially disposed anchor shoes, and were employed to advance the machine frame and the cutterhead longitudinally. The twelve anchor shoes were individually gripped against the tunnel wall by short, radially disposed anchoring jacks that interconnected the anchor shoes and the machine frame. The connection between each anchoring jack and the machine frame was a pair of meshed gears that resulted in pivotal movement of the anchor jack with respect to the machine frame when the tunneling machine was advanced on that anchoring jack and anchor shoe.

The above construction was divided into two sets of six anchor shoes and anchoring jacks. One set of six anchor shoes gripped the tunnel wall due to extension of their associated six anchoring jacks, while the other set of six anchor shoes were in an ungripped position on their six retracted anchoring jacks. The advancing jacks between the machine frame and the first set of anchor shoes would be extended to advance the cutterhead and the machine frame. The advancing jacks between the machine frame and the second set of anchor shoes would be retracted to slide the second set of anchor shoes forward. The second set of anchoring jacks would move forward due to their connection to the machine frame.

The Stillwater tunneling machine encountered operating difficulties due to the large number of anchor shoes, anchoring jacks and advancing jacks. Additionally, the geared pivotal connection between the anchoring jacks and the machine frame caused localized stress on the bases of the anchoring jacks. Finally, the pivotal movement of the anchoring jacks relative to the machine frame limited the forward stroke during each anchor shoe gripping.

German Patent No. 2,252,308 discloses an apparatus for the active mechanized support of tunnels which is a shield type machine as opposed to a tunnel boring machine employing a rotary cutterhead. The machine disclosed in this German patent, in one embodiment, employs five extendable shoes and a sixth fixed bottom shoe.

It should be noted that none of the above patents teaches a tunnel boring machine which advances in a substantially continuous manner, with the exception of the machine disclosed in the above Fikse patent. However, the tunnel boring machine disclosed in the Fikse patent suffers from lateral instability due to the fact that the machine is only gripped against the tunnel walls by two diametrically opposite anchor shoes at a time. Specifically, when the top and bottom anchor shoes of Fikse are gripped against the tunnel wall, the cutterhead can skew about a vertical axis. Similarly, while the Fikse tunnel boring machine is anchored by the left and right anchor shoes, the cutterhead can skew about a horizontal axis. Additionally, the central portion of the tunnel boring machine disclosed in the Fikse patent is crowded with the two pairs of upright shoe setting jacks and the two pairs of transverse shoe setting jacks such that the machines central portion is essentially useless for passage of tunneled material, personnel, and equipment therethrough.

A need thus exists for a tunnel boring machine having floating shoes that can continuously bore a tunnel without skewing and with greater efficiency. A need also exists for a tunnel boring machine of the above type having two sets of three anchor shoes floating relative to the frame of the tunnel boring machine and disposed circumferentially thereon, with the anchor shoes of the two sets alternating on the frame. The above orientation of these six anchor shoes allows continuous advance of the tunnel boring machine on three anchor shoes at a time. Thus, the tunnel boring machine of the present invention has increased cutterhead lateral stability due to its three shoe support, with the shoes relatively oriented about 120° apart as opposed to two shoe support with the shoes oriented at 180°. The need also exists for a tunnel boring machine of the above type in which the two sets of three anchor shoes are each interconnected by three pairs of floating gripper cylinders, with each pair of gripper cylinders acting longitudinally on the two anchor shoes that they connect. The above configuration of two sets of three pairs of floating gripper cylinders results in these gripper cylinders being disposed substantially circumferentially around the interior of the tunnel boring machine such that the interior is much more open for passage of tunneled material, personnel, and equipment. The need also exists for a tunnel boring machine of the above type having a small enough number of anchor shoes, gripper cylinders and thrust cylinders such that the machine operates reliably. Finally, a need exists for a tunnel boring machine of the above type in which the gripper cylinders interconnect two anchor shoes, and are not pivotally connected to the machine frame. This configuration reduces localized stress at the point of connection of the gripper cylinder.

SUMMARY OF THE INVENTION

A tunnel boring machine has a full face rotary cutterhead with a plurality of cutting units. Two sets of three anchor shoes walk relative to the frame and are disposed circumferentially thereof. The anchor shoes of each of the two sets alternate on the frame, with the anchor shoes within one set being equally spaced apart. Two sets of three thrust cylinder bipods, also known as propel cylinder bipods, connect the two sets of anchor shoes to the frame. One set of three thrust cylinder bipods is connected to each set of three floating anchor shoes, with one bipod attached to each anchor shoe. The apex of each thrust cylinder bipod is connected to the frame and the legs of each thrust cylinder bipod are connected adjacent opposite sides of the attached anchor shoe.

All of the anchor shoes in each set are interconnected by three pairs of floating gripper cylinders, with each pair of gripper cylinders longitudinally spaced on the two anchor shoes that they connect. Each of the two sets of three anchor shoes is sequentially gripped and ungripped relative to the tunnel wall by action of the gripper cylinders, and each set of anchor shoes is gripped and ungripped alternately relative the other set of anchor shoes.

The ungripped set of anchor shoes and the frame are advanced with respect to the gripped set of anchor shoes by the three thrust cylinder bipods connected to the gripped set of anchor shoes. After the thrust cylinder bipods connected to the gripped set of three anchor shoes are extended, the three pairs of floating gripper cylinders connected to the currently ungripped anchor shoes are then extended to grip these anchor shoes. Next, the originally gripped set of anchor shoes are ungripped by retraction of their gripper cylinders. These newly ungripped anchor shoes and the frame are then advanced with respect to the newly gripped set of anchor shoes by the three thrust cylinder bipods connected to the newly gripped set of anchor shoes. Additionally, the thrust cylinder bipods connected to the newly ungripped set of three anchor shoes are retracted in order to further move these anchor shoes forwardly with respect to the gripped set of anchor shoes.

Variable actuation of individual thrust cylinder bipods within each set of thrust cylinder bipods causes differential movement of the frame relative to the individual anchor shoes of each of the two sets of anchor shoes. This differential anchor shoe movement allows steering of the tunnel boring machine.

BRIEF DESCRIPTION OF THE DRAWINGS

These and other features of the invention will be more fully apparent when considered in light of the following specification and drawings in which:

FIG. 4 is a transverse vertical section taken at line 4—4 of FIG. 2 showing the first set of anchor shoes in the ungripped position and the second set of anchor shoes in the gripped position;

FIG. 5 is a vertical section corresponding to FIG. 4, but showing both the first set and the second set of anchor shoes in the gripped position for transition of gripping between the two sets of anchor shoes;

FIG. 6 is a transverse vertical section taken at line 6—6 of FIG. 3 showing the first set of anchor shoes in the gripped position and the second set of anchor shoes in the ungripped position;

FIGS. 7, 9, 11, 13, 15, and 17 are diagrammatic longitudinal sections through the tunneling machine typifying the present invention in which FIG. 7 shows the second set of anchor shoes gripped; FIG. 9 shows the second set of anchor shoes gripped and their corresponding thrust cylinders extended; FIG. 11 shows all of the anchor shoes gripped; FIG. 13 shows the first set of anchor shoes gripped; FIG. 15 shows the first set of anchor shoes gripped, their corresponding thrust cylinder extended, and the thrust cylinder of the second set of anchor shoes retracted; and FIG. 17 shows all of the anchor shoes gripped.

DETAILED DESCRIPTION OF THE PREFERRED EMBODIMENTS

Figure 1:
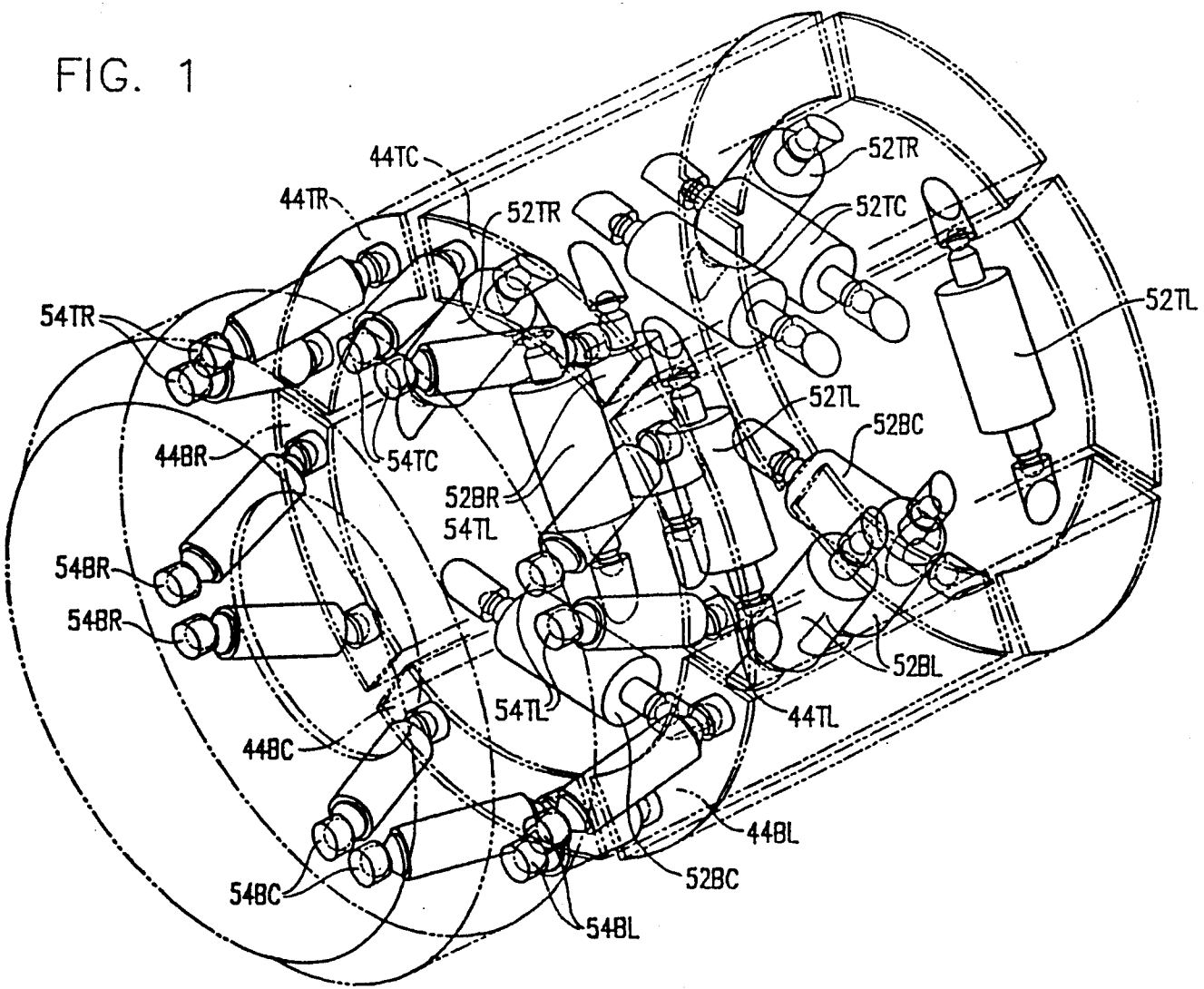
FIG. 1 is a top perspective view of a tunneling machine typifying the present invention illustrating the anchor shoes, gripper cylinders and thrust cylinders for advancing the tunneling machine frame and ungripped shoes relative to the gripped shoes.
Figure 2:
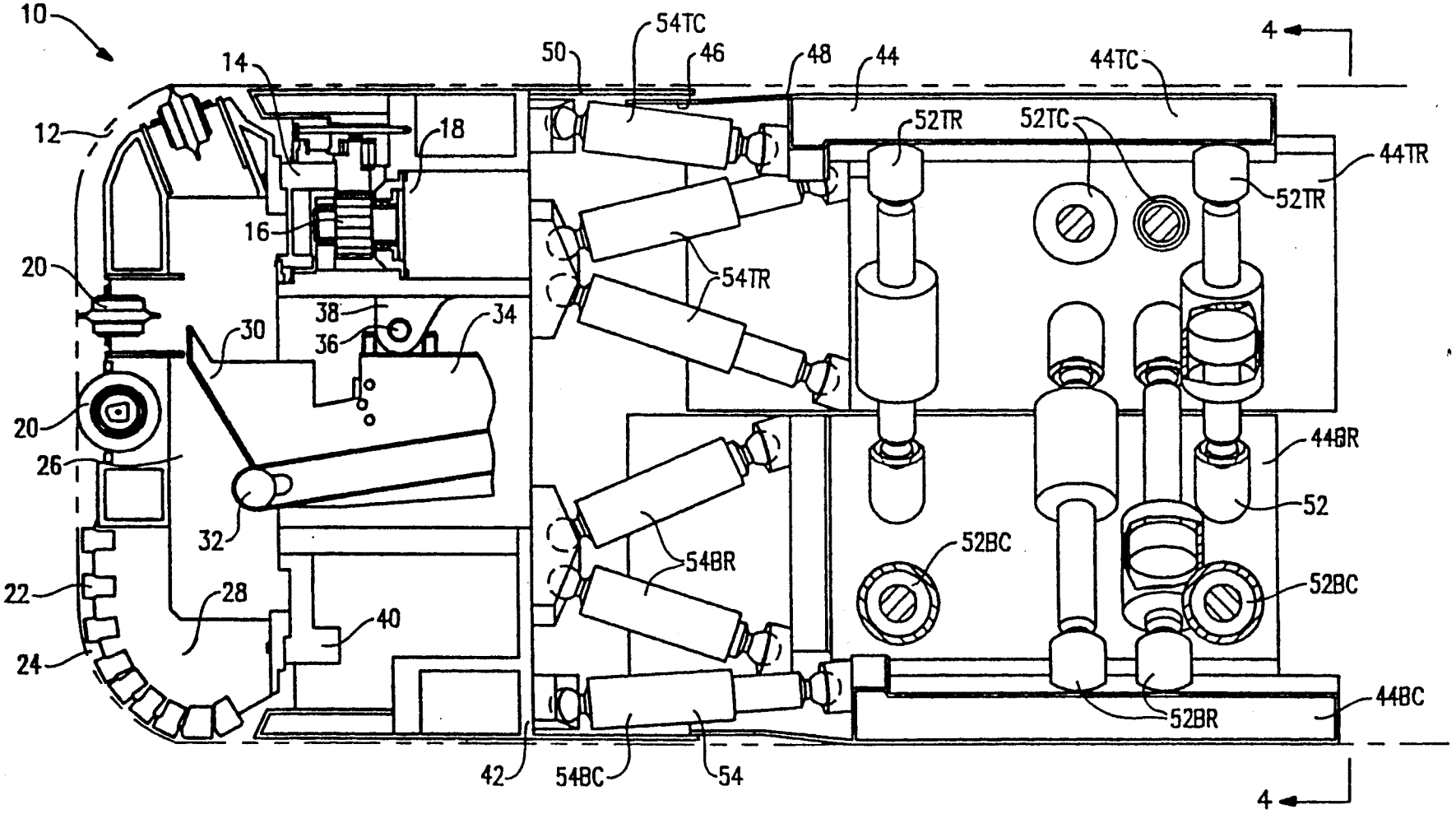
FIG. 2 is a longitudinal vertical section through the tunneling machine typifying the present invention with the first set of anchor shoes in the ungripped position and the second set of anchor shoes in the gripped position.
Figure 3:
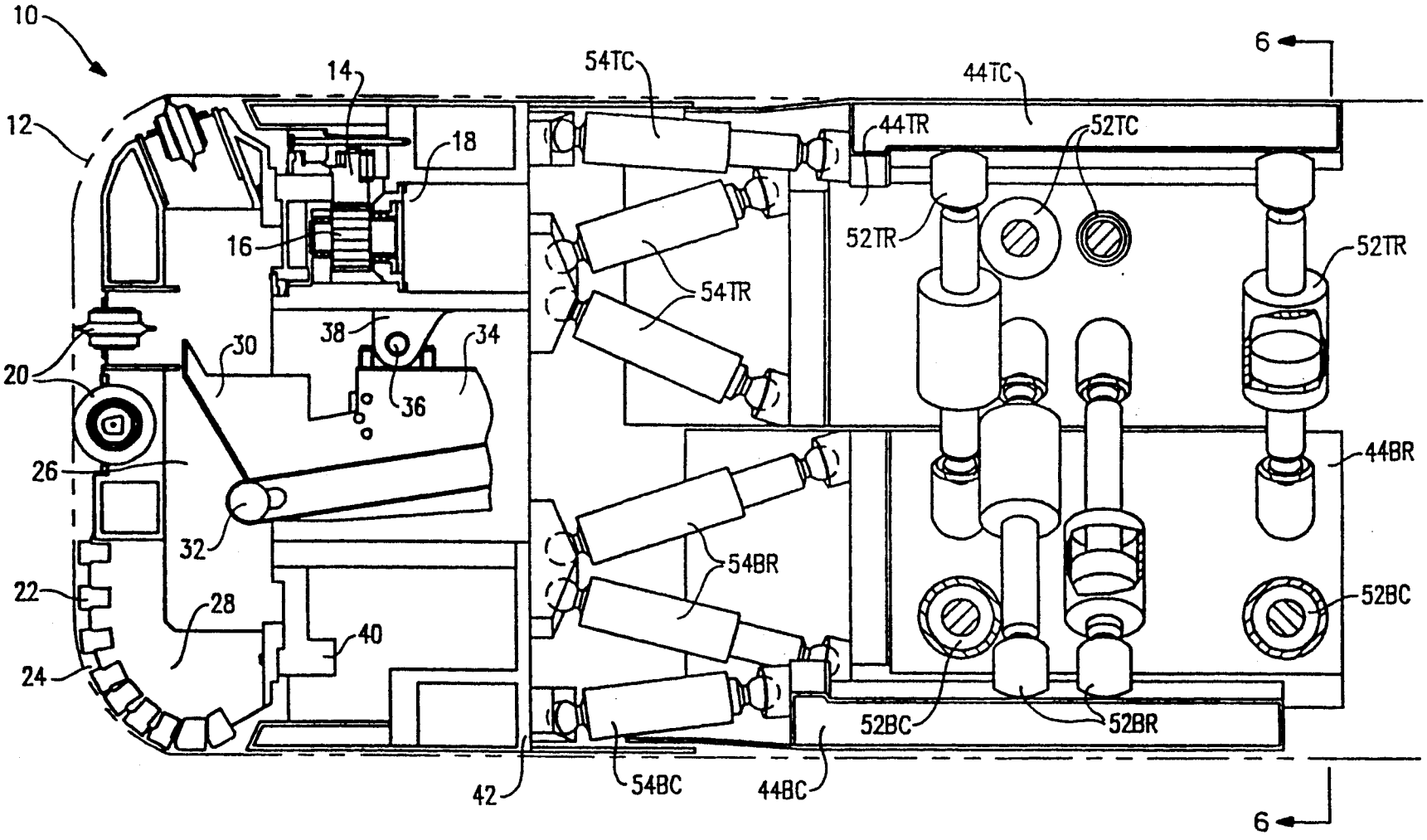
FIG. 3 is a longitudinal vertical section through the tunneling machine typifying the present invention with the first set of anchor shoes in the gripped position and the second set of anchor shoes in the ungripped position.

Referring to FIGS. 2 and 3, tunneling machine 10 includes full face cutterhead 12 rotatable thereon about ring gear 14 on cutterhead support 40. Ring gear 14 intermeshes with pinion 16, which is powered by cutterhead drive units one of which is shown at 18.

Cutterhead 12 includes a plurality of roller cutters 20 on its face, and a plurality of drag picks 22 adjacent muck openings 24 for passage of muck therethrough. Cutterhead chamber 26 includes a plurality of muck buckets 28 radially disposed therein. Muck collected in muck buckets 28 as cutterhead 12 rotates, is deposited on muck apron 30 which channels the muck to conveyor 32. Conveyor 32 is supported by a muck conveyor beam 34 which is, in turn, attached by pin 36 to bracket 38. Bracket 38 is integral with frame 42 of tunneling machine 10. As will be recognized, all of these components 12–42 of tunneling machine 10 are conventional per se.

This embodiment of the present invention adds to these conventional elements floating shoe anchoring mechanism including two sets of anchor shoes 44 floating relative to the tunnel machine body. Each set of anchor shoes 44 includes three anchor shoes and each anchor shoe has an arcuate circumferential extent approximately 1/6th of the circumferential extent of frame 42. Additionally, each shoe is joined to a forwardly projecting anchor shoe arcuate shield 46, having a smaller cylindrical arcuate shape, by a transition portion 48. The circumferential size of the anchor shoe arcuate shield 46 is smaller than the circumferential size of trailing section 50 of frame 42 so that anchor shoe arcuate shield 46 underlaps trailing portion 50 of frame 42 enabling anchor shoe arcuate shield 46 and frame 42 to slide relatively longitudinally with respect to each other.

The two sets of floating anchor shoes 44 that are circumferentially disposed on frame 42 are preferably oriented on frame 42 such that the three anchor shoes of one set alternate with the three anchor shoes of the other set, and the three anchor shoes within one set are preferably substantially equally spaced circumferentially on frame 42. Referring specifically to FIGS. 1, 4 through 6, and 8, 10, 12, 14, 16, and 18, the two sets of anchor shoes 44 are divided into a first set and a second set for the sake of clarity. The first set of anchor shoes 44 includes top center shoe 44TC, bottom left shoe 44BL, and bottom right shoe 44BR. The second set of anchor shoes 44 includes top left shoe 44TL, top right shoe 44TR, and bottom center shoe 44BC.

Two sets of three pairs of gripper cylinders 52 connect the anchor shoes within each of the two sets of anchor shoes 44. More specifically, a first set of three gripper cylinder pairs 52 interconnects the above-mentioned first set of three floating anchor shoes 44TC, 44BL, and 44BR. Thus, bottom center gripper cylinder pair 52BC interconnects bottom left anchor shoe 44BL and bottom right anchor shoe 44BR. Top left gripper cylinder pair 52TL interconnects top center anchor shoe 44TC and bottom left anchor shoe 44BL. Finally, top right gripper cylinder pair 52TR interconnects top center anchor shoe 44TC and bottom right anchor shoe 44BR. The second set of three gripper cylinder pairs 52 interconnects the above-described second set of three anchor shoes comprised of top left anchor shoe 44TL, top right anchor shoe 44TR, and bottom center anchor shoe 44BC. Thus, top center gripper cylinder pair 52TC interconnect top left anchor shoe 44TL and top right anchor shoe 44TR. Bottom left gripper cylinder pair 52BL interconnect top left anchor shoe 44TL and bottom center anchor shoe 44BC. Finally, bottom right gripper cylinder pair 52BR interconnect top right anchor shoe 44TR and bottom center anchor shoe 44BC. Each pair of gripper cylinders of the above-described six gripper cylinder pairs 52 is attached to the respective floating anchor shoes such that each gripper cylinder of the gripper cylinder pair is spaced longitudinally on the connected anchor shoes with respect to the other gripper cylinder of that gripper cylinder pair. As readily apparent, the above connection of the first and second set of three gripper cylinder pairs 52 with the above first and second set of three anchor shoes 44 provides a gripper cylinder configuration within frame 42 of tunneling machine 10 such that the center portion of frame 42 is essentially unencumbered by gripper cylinders, thus allowing adequate room for passage of tunneled material, machine operators and equipment therethrough.

Further considering the orientation and interaction of the six gripper cylinder pairs 52 with respect to each other on the six floating anchor shoes 44, the first set of three gripper cylinder pairs 52 (bottom center gripper cylinder pair 52BC, top right gripper cylinder pair 52TR, and top left gripper cylinder pair 52TL) is oriented on their respective anchor shoes relatively exteriorly of the second set of three gripper cylinder pairs 52 (top center gripper cylinder pair 52TC, bottom right gripper cylinder pair 52BR, and bottom left gripper cylinder pair 52BL). This orientation of the six gripper cylinder pairs allows relative forward movement, i.e. "floating" of the ungripped anchor shoes and ungripped gripper cylinders with respect to the gripped anchor shoes and gripped gripper cylinders. Thus, the spacing of the more widely spaced, or exterior, first set of three cylinder pairs relative to the spacing of the more closely spaced, or interior, second set of gripper cylinder pairs dictates the amount of advance of tunneling machine 10 for each gripping of one of the two sets of three gripper cylinder pairs. For example, as shown in FIG. 2 and 4, the second set of anchor shoes 44 (top left shoe 44TL, top right shoe 44TR and bottom center shoe 44BC) is gripped to the tunnel wall by the second, interior, set of three gripper cylinder pairs 52 (top center gripper cylinder pair 52TC, bottom left gripper cylinder pair 52BL, and bottom right gripper cylinder pair 52BR). Thus, the first set of anchor shoes 44 (top center shoe 44TC, bottom left shoe 44BL, and bottom right shoe 44BR) as well as the first and exterior set of three gripper cylinder pairs 52 (bottom center gripper cylinder pair 52BC, top left gripper cylinder pair 52TL, and top right gripper cylinder pair 52TR) can float relative to the above-described second set of anchor shoes 44 and second, and interior, set of three gripper cylinder pairs 52, but such forward or axial floating is limited by the relative spacing of the exterior first set of gripper cylinder pairs 52 relative to the spacing of the second, and interior, set of three gripper cylinder pairs 52.

Forward propulsion and steering of tunneling machine 10 is caused by thrust cylinder bipods 54. Preferably six thrust cylinder bipods are present, for a total of twelve thrust cylinders. One thrust cylinder bipod interconnects the frame 42 and an associated anchor shoe 44. Specifically, three thrust cylinder bipods 54 form a first set of thrust cylinder bipods and each bipod of this first set is interconnected with one anchor shoe 44 of the first set of anchor shoes. Thus, top center thrust cylinder bipod 54TC is connected to top center shoe 44TC, bottom left thrust cylinder bipod 54BL is connected to bottom left shoe 44BL, and bottom right thrust cylinder bipod 54BR is connected to bottom right shoe 44BR. Likewise, a second set of thrust cylinder bipods 54 comprised of three bipods is oriented so that each thrust cylinder bipod is connected to one of the anchor shoes 44 of the second set of anchor shoes. Thus, top left thrust cylinder bipod 54TL is connected to top left shoe 44TL, top right thrust cylinder bipod 54TR is connected to top right shoe 44TR, and bottom center thrust cylinder bipod 54BC is connected to bottom center shoe 44BC. Preferably, the apex of each of these thrust cylinder bipods 54 is pivotally attached to frame 42, and the two legs of each thrust cylinder bipod 54 is pivotally attached to its corresponding anchor shoe 44. More specifically, each leg of thrust cylinder bipod 54 is attached adjacent an opposite side of its corresponding anchor shoe 44. As will be apparent, the first set of thrust cylinder bipods 54 works independently of the second set of thrust cylinder bipods 54 so that the ungripped set of anchor shoes 44 (for example the first set) and the ungripped set of gripper cylinders 52 (for example the first set) may be advanced by their attachment to frame 42 when the opposite set of anchor shoes 44 (for example the second set) and the opposite set of gripper cylinders 52 (for example the second set) grip the tunnel wall and the second set of thrust cylinder bipods 54, thrust frame 42 and cutterhead 12 relatively forwardly.

Note that variable extension or retraction by means known in the art of one thrust cylinder of a pair of thrust cylinder bipods in a set of thrust cylinder bipods 54 causes clockwise or counterclockwise rolling of tunneling machine 10. Variable extension or retraction of one or more thrust cylinder bipods with respect to the other thrust cylinder bipods in a set of thrust cylinder bipods 54 causes upward, downward, left hand, and right hand turning of tunneling machine 10.

To consider in more detail the manner of operation of tunneling machine 10 with continuous advance of cutterhead 12, reference is made to FIGS. 2 through 18, illustrating the operational sequence. Specifically FIGS. 2 and 4 show one of the two gripped sequences in which the first set of anchor shoes 44 (top center shoe 44TC, bottom left shoe 44BL and bottom right shoe 44BR) are all in the ungripped position by retraction of the first set of gripper cylinder pairs 52 (bottom center gripper cylinder pair 52BC, top left gripper cylinder pair 52TL and top right gripper cylinder pair 52TR) and the second set of anchor shoes 44 (top left shoe 44TL, top right shoe 44TR and bottom center shoe 44BC) are in the gripped configuration by extension of the second set of gripper cylinder pairs 52 (top center gripper cylinder pair 52TC, bottom left gripper cylinder pair 52BL and bottom right gripper cylinder pair 52BR).

FIG. 5 shows the transitional relationship between the two gripped positions of the present invention in which both sets of the anchor shoes 44 (top center shoe 44TC, bottom left shoe 44BL and bottom right shoe 44BR as well as top left shoe 44TL, top right shoe 44TR and bottom center shoe 44BC are in the gripped position based upon extension of both sets of gripper cylinder pairs 52 (bottom center gripper cylinder pair 52BC, top left gripper cylinder pair 52TL, top right gripper cylinder pair 52TR, as well as top center gripper cylinder pair 52TC, bottom left gripper cylinder pair 52BL and bottom right gripper cylinder pair 52BR).

FIGS. 3 and 6 show the other of the two gripped positions of the present invention in which the first set of anchor shoes 44 (top center shoe 44TC, bottom left shoe 44BL, and bottom right shoe 44BR) are in the gripped position due to extension of the first set of gripper cylinder pairs 52 (bottom center gripper cylinder pair 52BC, top left gripper cylinder pair 52TL, and top right gripper cylinder pair 52TR), and the second set of anchor shoes 44 (top left shoe 44TL, top right shoe 44TR, and bottom center shoe 44BC) are in the ungripped position due to retraction of the second set of gripper cylinder pairs 52 (top center gripper cylinder pair 52TC, bottom left gripper cylinder pair 52BL, and bottom right gripper cylinder pair 52BR).

Now referring to FIGS. 7 through 18, the continuous cutterhead advance of tunneling machine 10 is further illustrated where the two gripped sequences of FIGS. 2, 3, 4 and 6 and the transition sequence of FIG. 5, all of which show the relative positions of anchor shoes 44 and gripper cylinder pairs 52, are now combined with the relative extension and retraction of thrust cylinder bipods 54. It is to be noted that when anchor shoes 44 are shown in the ungripped position in the above-mentioned Figures, these ungripped anchor shoes 44 are shown in an exaggerated position remote from the tunnel wall for purposes of clarity. However, it is to be understood that in actual operation, ungripped anchor shoes 44 are preferably always in contact with the tunnel wall, and the ungripped position of anchor shoes 44 is actually the configuration in which the associated gripper cylinder paris 52 are not forcing the anchor shoes 44 against the tunnel wall. In this ungripped position the anchor shoes 44 can slide along the tunnel wall during advancement of tunneling machine 10.

Figure 7:
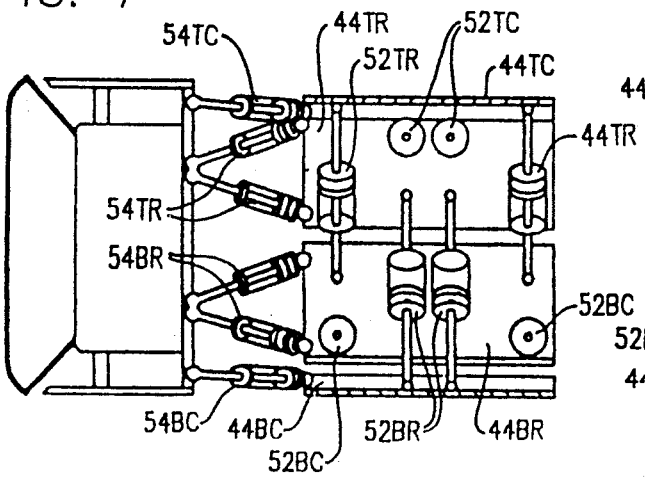
Figure 8:
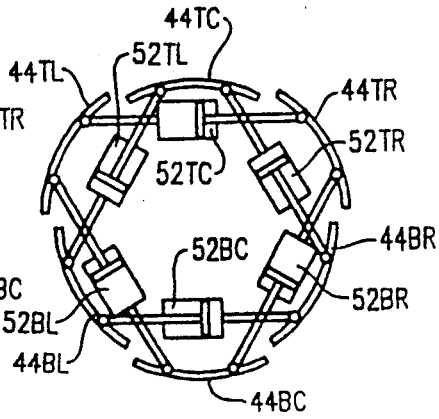
FIGS. 8, 10, 12, 14, 16, and 18 are diagrammatic transverse vertical sections corresponding to FIGS. 7, 9, 11, 13, 15, and 17 respectively taken through line 4—4 of FIG. 2.

First referring to FIGS. 7 and 8, the first set of anchor shoes 44 (top center shoe 44TC, bottom left shoe 44BL, and bottom right shoe 44BR) is in the ungripped position due to retraction of the first set of gripper cylinder pairs 52 (bottom center gripper cylinder pair 52BC, top left gripper cylinder pair 52TL, and top right gripper cylinder pair 52TR). The second set of anchor shoes 44 (top left shoe 44TL, top right shoe 44TR, and bottom center shoe 44BC) is in the gripped position due to an extension of the second set of gripper cylinder pairs 52 (top center gripper cylinder 52TC, bottom left gripper cylinder 52BL, and bottom right gripper cylinder 52BR). At this time, all thrust cylinder bipods (thrust cylinder bipod 54TC, thrust cylinder bipod 54BL, thrust cylinder bipod 54BR, thrust cylinder bipod 54TL, thrust cylinder bipod 54TR, and thrust cylinder bipod 54BC) are in the retracted position.

Figure 9:
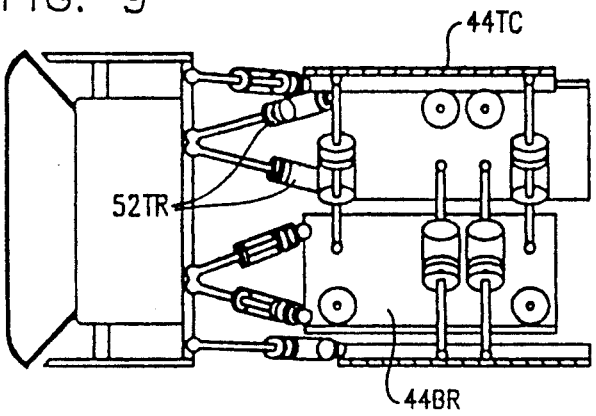
Figure 10:
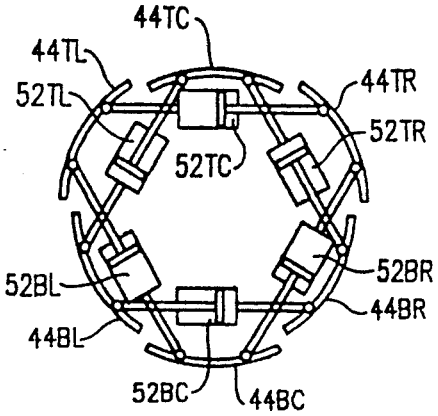

Next referring to FIGS. 9 and 10, the first set of anchor shoes 44 (top center shoe 44TC, bottom left shoe 44BL, and bottom right shoe 44BR) is still in the ungripped position, and the second set of anchor shoes 44 (top left shoe 44TL, top right shoe 44TR, and bottom center shoe 44 BC) is still gripped. The second set of thrust cylinder bipods 54 (top left thrust cylinder bipod 54TL, top right thrust cylinder bipod 54TR, and bottom center thrust cylinder bipod 54BC) that are connected to the gripped second set of anchor shoes 44 is now extended such that frame 42 and cutterhead 12 are thrust forward. This forward propulsion of frame 42, in turn, causes forward propulsion of the ungripped first set of anchor shoes 44 (top center shoe 44TC, bottom left shoe 44BL, and bottom right shoe 44BR) and the retracted first set of gripper cylinder pairs 52 (bottom center gripper cylinder pair 52BC, top left gripper cylinder pair 52TL, and top right gripper cylinder pair 52TR) with respect to the gripped second set of anchor shoes 44 (top left shoe 44TL, top right shoe 44TR, and bottom center shoe 44BC). FIGS. 9 and 10 thus show one of the two gripped positions of the present invention with accompanying forward thrusting for relative movement of cutterhead 12, frame 42, the ungripped set of anchor shoes 44 and the retracted set of gripper cylinder pairs 52 with respect to the gripped set of anchor shoes 44 and the extended set of gripper cylinder pairs 52.

Figure 11:
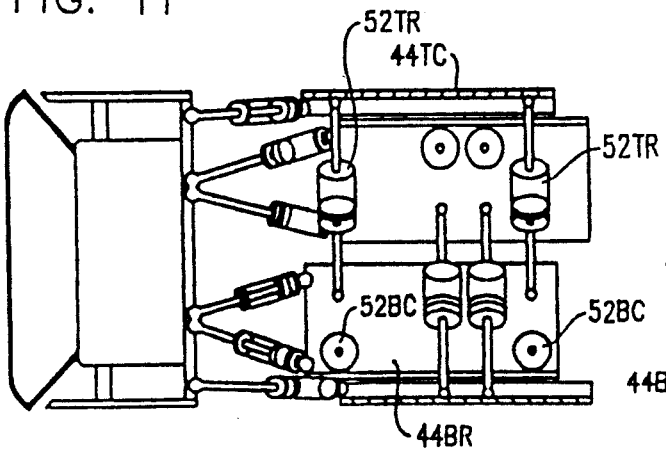
Figure 12:
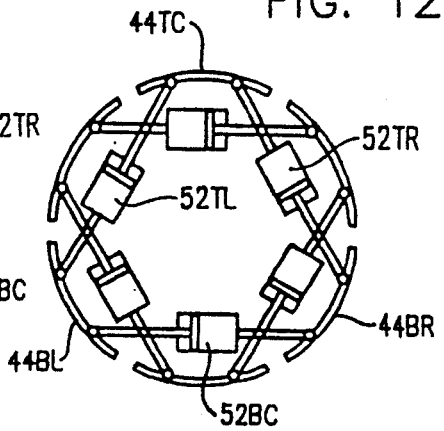

FIGS. 11 and 12 show the transitional relationship between the first and second gripped positions of the present invention. Specifically, the second set of thrust cylinder bipods 54 (top left thrust cylinder bipod 54TL, top right thrust cylinder bipod 54TR, and bottom center thrust cylinder bipod 54BC) are still in the extended position. Likewise, the second set of anchor shoes (top left shoe 44TL, top right shoe 44TR, and bottom center shoe 44BC) is still in the gripped position. However, the first set of anchor shoes 44 (top center shoe 44TC, bottom left shoe 44BL, and bottom right shoe 44BR) is now in the gripped position due to extension of the first set of gripper cylinder pairs 52 (bottom center gripper cylinder pair 52BC, top left gripper cylinder pair 52TL, and top right gripper cylinder pair 52TR).

Figure 13:
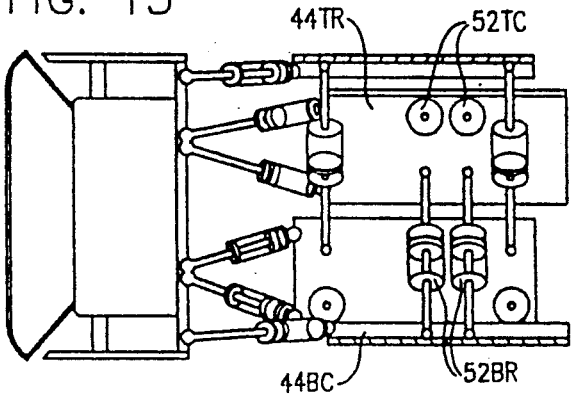
Figure 14:
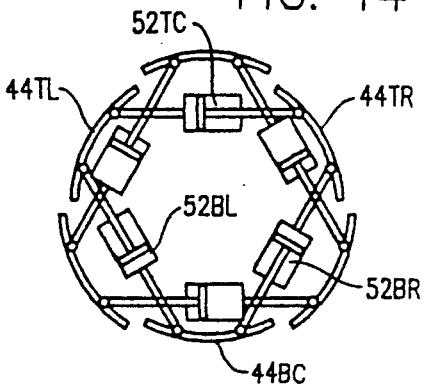

In FIGS. 13 and 14, the second of the two gripped positions of the present invention is shown. Specifically, the first set of anchor shoes 44, top center shoe 44TC, bottom left shoe 44BL, and bottom right shoe 44BR) is still in the gripped position. However, the second set of anchor shoes 44 (top left shoe 44TL, top right shoe 44TR, and bottom center shoe 44BC) is now in the ungripped position due to retraction of the second set of gripper cylinder pairs 52 (top center gripper cylinder pair 52TC, bottom left gripper cylinder pair 52BL, and bottom right gripper cylinder pair 52BR).

Figure 15:
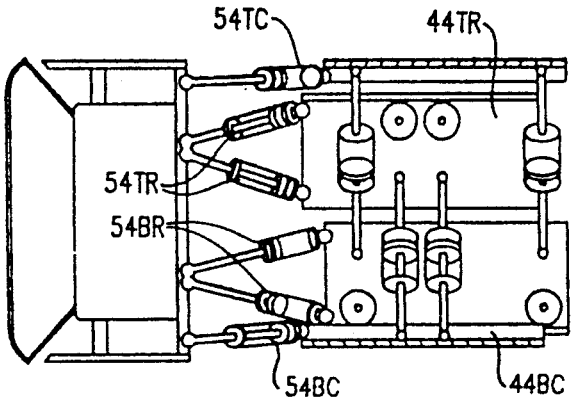
Figure 16:
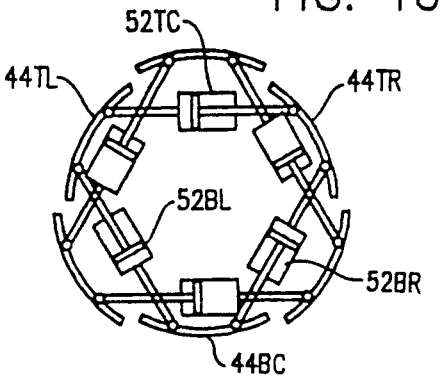

Now referring to FIGS. 15 and 16, the second of the two gripped positions in conjunction with forward thrusting is shown. Specifically, the first set of anchor shoes 44 (top center shoe 44TC, bottom left shoe 44BL, and bottom right shoe 44BR) is still in the gripped position, and the second set of anchor shoes 44 (top left shoe 44TL, top right shoe 44TR, and bottom center shoe 44BC) is still in the ungripped position. Forward thrusting of cutterhead 12, frame 42, the ungripped second set of anchor shoes 44 (top left shoe 44TL, top right shoe 44TR, and bottom center shoe 44BC) and the retracted second gripper cylinder pairs 52 (top center gripper cylinder pair 52TC, bottom left gripper cylinder pair 52BL, and bottom right gripper cylinder pair 52BR) relative to the gripped first set of anchor shoes 44 (top center shoe 44TC, bottom left shoe 44BL, and bottom right shoe 44BR) is caused by extension of the first set of thrust cylinder bipods 54 (top center cylinder bipod 54TC, bottom left cylinder bipod 54BL, and bottom right cylinder bipod 54BR). Additionally, retraction of the second set of thrust cylinder bipods 54 (top left thrust cylinder bipod 54TL, top right thrust cylinder bipod 54TR and bottom center thrust cylinder bipod 54BC) which were extended in FIGS. 9 and 10, causes additional forward movement of the ungripped second set of anchor shoes 44 (top left shoe 44TL, top right shoe 44TR, and bottom center shoe 44BC) and the retracted second set of gripper cylinder pairs 52 (top center gripper cylinder pair 52TC, bottom left gripper cylinder pair 52BL, and bottom right gripper cylinder pair 52BR) with respect to the gripped first set of anchor shoes 44 (top center shoe 44TC, bottom left shoe 44BL, and bottom right shoe 44BR).

Figure 17:
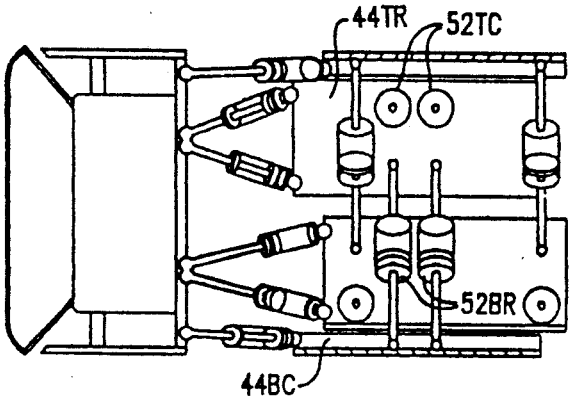
Figure 18:
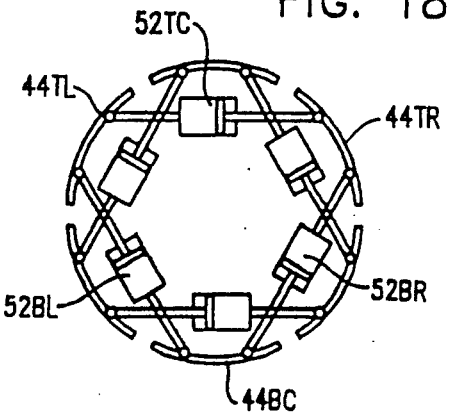

Referring now to FIGS. 17 and 18, the transitional relationship occurring after the second of the two gripped positions and associated thrusting is shown. The first set of thrust cylinder bipods 54 (top center thrust cylinder bipod 54TC, bottom left cylinder bipod 54BL, and bottom right thrust cylinder bipod 54BR) remains extended, and the second set of thrust cylinder bipods 54 (top left thrust cylinder bipod 54TL, top right thrust cylinder bipod 54TR, and bottom center thrust cylinder bipod 54BC) remains retracted. Additionally, the first set of anchor shoes 44 (top center shoe 44TC, bottom left shoe 44BL, and bottom right shoe 44BR) is still in the gripped position due to extension of the first set of gripper cylinder pairs 52 (bottom center gripper cylinder pair 52BC, top left gripper cylinder pair 52TL, and top right gripper cylinder pair 52TR). However, the second set of anchor shoes 44 (top left shoe 44TL, top right shoe 44TR, and bottom center shoe 44BC) is now in the gripped position due to extension of the second set of gripper cylinder pairs 52 (top center gripper cylinder pair 52TC, bottom left gripper cylinder pair 52BL, and bottom right gripper cylinder pair 52BR).

In order to initiate a new propel sequence, tunneling machine 10 is returned to the configuration of FIGS. 7 and 8 from that of FIGS. 17 and 18. Thus, referring again to FIGS. 7 and 8, the second set of anchor shoes 44 (top left shoe 44TL, top right shoe 44TR, and bottom center shoe 44BC) is still in the gripped position due to extension of the second set of gripper cylinder pairs 52 (top center gripper cylinder pair 52TC, bottom left gripper cylinder pair 52BL, and bottom right gripper cylinder pair 52BR). Additionally, the second set of thrust cylinder bipods 54 (top left thrust cylinder bipod 54TL, top right thrust cylinder bipod 54TR, and bottom center thrust cylinder bipod 54BC) is still in the retracted position. However, the first set of anchor shoes 44 (top center shoe 44TC, bottom left shoe 44BL, and bottom right shoe 44BR) is again in the gripped position due to extension of the first set of gripper cylinder pairs 52 (bottom center gripper cylinder pair 52BC, top left gripper cylnder pair 52TL, and top right gripper cylinder pair 52TR). Finally, the first set of thrust cylinder bipods 54 (top center thrust cylinder bipod 54TC, bottom left thrust cylinder bipod 54BL, and bottom right thrust cylinder bipod 54BR) is now retracted, thus sliding forwardly the ungripped first set of anchor shoes (top center shoe 44TC, bottom left shoe 44BL, and bottom right shoe 44BR) and the retracted first set of gripper cylinder pairs 52 (bottom center gripper cylinder pair 52BC, top left cylinder pair 52TL, and top right gripper cylinder pair 52TR) relative to the gripped second set of anchor shoes 44 (top left shoe 44TL, top right shoe 44TR, and bottom center shoe 44BC) and the extended second set of gripper cylinder pairs 52 (top center gripper cylinder pair 52TC, bottom left gripper cylinder pair 52BL, and bottom right gripper cylinder pair 52BR).

While particular embodiments of the present invention have been described in some detail, it will be recognized that changes and modifications may be made in other embodiments thereof without departing from the spirit and scope of the invention as defined in the following claims.

What is claimed is:

1. A tunnel boring machine comprising:

a frame;

a full face cutterhead on said frame having a plurality of cutting units, said cutterhead being rotatable with respect to said frame;

three anchor shoes floating relative to said frame and being disposed circumferentially thereof in an equispaced manner;

gripper means walkable relative to said frame and connecting each of said three anchor shoes to the other of said three anchor shoes, said gripper means being extensible to anchor said three anchor shoes against the tunnel wall; and thrust means connected to said frame and to each of said three anchor shoes for advancing said frame relative to said three anchor shoes.

2. The tunnel boring machine of claim 1, wherein said three anchor shoes are spaced substantially equidistant on said frame and said thrust means includes three thrust cylinder bipods connecting said three anchor shoes and said frame and being spaced substantially equidistant on said frame.

3. The tunnel boring machine of claim 1, wherein said thrust means comprises:

three thrust cylinder bipods, each thrust cylinder bipod connected to said frame and to one of said anchor shoes.

4. The tunnel boring machine of claim 3, wherein each thrust cylinder bipod has legs connected adjacent opposite sides of one of said three anchor shoes and each thrust cylinder bipod has an apex connected to said frame.

5. The tunnel boring machine of claim 1, wherein said frame includes a circumferential frame shield and each of said three anchor shoes includes a shield having a portion underlapping said frame shield for movement of said anchor shoes relative to said frame shield.

6. The tunnel boring machine of claim 1, wherein said gripper means comprises:

three pair of gripper cylinders interconnecting said three anchor shoes, each pair of gripper cylinders connecting two anchor shoes of said three anchor shoes such that each gripper cylinder of said pair is spaced from the other gripper cylinder of said pair longitudinally on the connected anchor shoes.

7. The tunnel boring machine of claim 1, wherein said thrust means includes a plurality of thrust cylinders energizable in varying amounts to steer said tunnel boring machine.

8. A tunnel boring machine comprising:

a frame;

a full face cutterhead on said frame having a plurality of cutting units, said cutterhead being rotatable with respect to said frame;

two sets of three anchor shoes floating relative to said frame and being disposed circumferentially thereof, the anchor shoes of one of said two sets alternating on said frame with the anchor shoes of the other of said two sets with each such shoe occupying subs 60° of the circumference thereof;

gripper means floating relative to said frame and connecting the three anchor shoes of each of said two sets such that each set of said two sets of three anchor shoes are substantially sequentially gripped with respect to the tunnel wall independently of the other of said two sets of anchor shoes to anchor said tunnel boring machine; and thrust means connected to said frame and to each anchor shoe in said two sets whereby said thrust means is substantially sequentially activated such that said frame and the one of said two sets of three anchor shoes that is ungripped are advanced with respect to the one of said two sets of three anchor shoes that is gripped.

9. The tunnel boring machine of claim 8, wherein the three anchor shoes of each of said two sets are spaced substantially equidistant on said frame and said thrust means includes two sets of three thrust cylinder bipods connecting said two sets of three anchor shoes and said frame and being spaced substantially equidistant on said frame.

10. The tunnel boring machine of claim 8, wherein said thrust means comprises:

two sets of three thrust cylinder bipods connected to said frame, one set of said two sets of three thrust cylinder bipods being connected to one set of said two sets of three anchor shoes, and the other set of said two sets of three thrust cylinder bipods being connected to the other set of said two sets of three anchor shoes such that each thrust cylinder bipod is connected to a corresponding anchor shoe.

11. The tunnel boring machine of claim 10, wherein the legs of each thrust cylinder bipod are connected adjacent opposite sides of said corresponding anchor shoe and the apex of each thrust cylinder bipod is connected to said frame.

12. The tunnel boring machine of claim 10, wherein each set of said two sets of three thrust cylinder bipods are energized substantially sequentially with respect to the other set of said two sets of three thrust cylinder bipods such that said frame and the one of said two sets of three anchor shoes that is ungripped are advanced with respect to the one of said two sets of anchor shoes that is gripped.

13. The tunnel boring machine of claim 8, wherein said frame includes a circumferential support and each of said two sets of three anchor shoes includes a support having a portion underlapping said frame support for movement of said two sets of three anchor shoes relative to said frame.

14. The tunnel boring machine of claim 8, wherein said gripper means comprises:

two sets of three pair of gripper cylinders, one set of said two sets of three pair of gripper cylinders interconnecting one set of said two sets of three anchor shoes, and the other set of said two sets of three pair of gripper cylinders interconnecting the other set of said two sets of three anchor shoes such that each pair of gripper cylinders connect two anchor shoes of a set of three anchor shoes such that each gripper cylinder of a pair is spaced from the other gripper cylinder of a pair longitudinally on the connected anchor shoes.

15. The tunnel boring machine of claim 8, wherein said thrust means includes a plurality of thrust cylinders energizable in varying amounts to steer said tunnel boring machine.

16. A tunnel boring machine comprising a frame;

a cutterhead on said frame having a plurality of cutting units, said cutterhead rotatable with respect to said frame;

two sets of three anchor shoes floating relative to said frame and being disposed circumferentially thereof, the anchor shoes of one of said two sets alternating on said frame with the anchor shoes of the other of said two sets, the three anchor shoes of each of said two sets being spaced substantially equidistant on said frame;

two sets of three pair of floating gripper cylinders, one set of said two sets of gripper cylinders interconnecting one set of said two sets of three anchor shoes, and the other set of said two sets of three pair of gripper cylinders interconnecting the other set of said two sets of three anchor shoes such that each pair of gripper cylinders connect two anchor shoes of a set of three anchor shoes whereby each gripper cylinder of a pair is spaced from the other gripper cylinder of a pair longitudinally on the connected anchor shoes, each set of said two sets of three anchor shoes being substantially sequentially gripped and ungripped with respect to the tunnel wall independently of the other of said two sets of anchor shoes; and two sets of three thrust cylinder bipods connected to said frame, one set of said two sets of three thrust cylinder bipods being connected to one set of said two sets of three anchor shoes, and the other set of said two sets of three thrust cylinder bipods being connected to the other set of said three anchor shoes such that each thrust cylinder bipod is connected to a corresponding anchor shoe whereby said two sets of three thrust cylinder bipods are substantially sequentially actuated such that said frame and the one of said two sets of three anchor shoes that is ungripped are advanced with respect to the one of said two sets of three anchor shoes that is gripped.

17. The tunnel boring machine of claim 16, wherein the legs of each thrust cylinder bipod are connected adjacent opposite sides of said corresponding anchor shoe and the apex of each thrust cylinder bipod is connected to said frame.

18. The tunnel boring machine of claim 16, wherein said frame includes a circumferential support and each of said two sets of three anchor shoes includes a support having a portion underlapping said frame support for movement of said two sets of three anchor shoes relative to said frame.

19. The tunnel boring machine of claim 16, wherein said thrust means includes a plurality of thrust cylinders energizable in varying amounts to steer said tunnel boring machine.

* * * * *